United States Patent [19]

Welsh

[11] 4,038,902

[45] Aug. 2, 1977

[54] ARTILLERY WEAPON

[76] Inventor: Robert B. Welsh, 725 Providence Road, Charlotte, N.C. 28207

[21] Appl. No.: 715,144

[22] Filed: Aug. 17, 1976

[51] Int. Cl.[2] ..... F41F 3/04

[52] U.S. Cl. ..... 89/1.807; 89/1.803; 89/1.812; 89/1.813; 89/1.816; 89/41 B

[58] Field of Search ..... 89/1.806, 1.801, 1.803, 89/1.807, 1.812, 1.813, 1.814, 1.816, 41 B, 41 A, 1.8

[56] References Cited

U.S. PATENT DOCUMENTS

| | | | |
|---|---|---|---|
| 1,479,840 | 1/1924 | Stone | 89/41 A |
| 2,557,151 | 6/1951 | Skinner et al. | 89/1.814 |
| 2,717,534 | 9/1955 | Atherton | 89/1.803 |
| 2,949,825 | 8/1960 | Musser et al. | 89/41 A |
| 3,204,530 | 9/1965 | McGowan | 89/1.813 |
| 3,212,402 | 10/1965 | Hengel et al. | 89/1.801 |
| 3,225,655 | 12/1965 | Inglis | 89/1.816 |
| 3,368,454 | 2/1968 | Peck et al. | 89/41 B |
| 3,447,778 | 5/1969 | Bates | 89/1.816 X |

FOREIGN PATENT DOCUMENTS

| | | | |
|---|---|---|---|
| 935,900 | 9/1963 | United Kingdom | 89/1.814 |

*Primary Examiner*—David H. Brown

*Attorney, Agent, or Firm*—Mason, Fenwick & Lawrence

[57] ABSTRACT

A hand-held artillery weapon for aiming a rocket projectile at a desired target by striking the target with rocket darts including a projectile barrel for launching the rocket projectile, a dart barrel mounted on the projectile barrel with the axis of the dart barrel generally parallel to the axis of the projectile barrel, magazine means for supplying an unfired dart to the dart barrel after a dart has been fired, means for retaining the dart in the dart barrel prior to firing of the dart, means for firing a dart retained in the dart barrel, means for retaining a projectile in the projectile barrel prior to firing of the projectile and means for firing the projectile thereby providing an artillery weapon which can be targeted on a desired target by firing as many lightweight and inexpensive rocket darts as necessary to position the projectile barrel in the desired orientation for firing of the rocket projectile.

9 Claims, 14 Drawing Figures

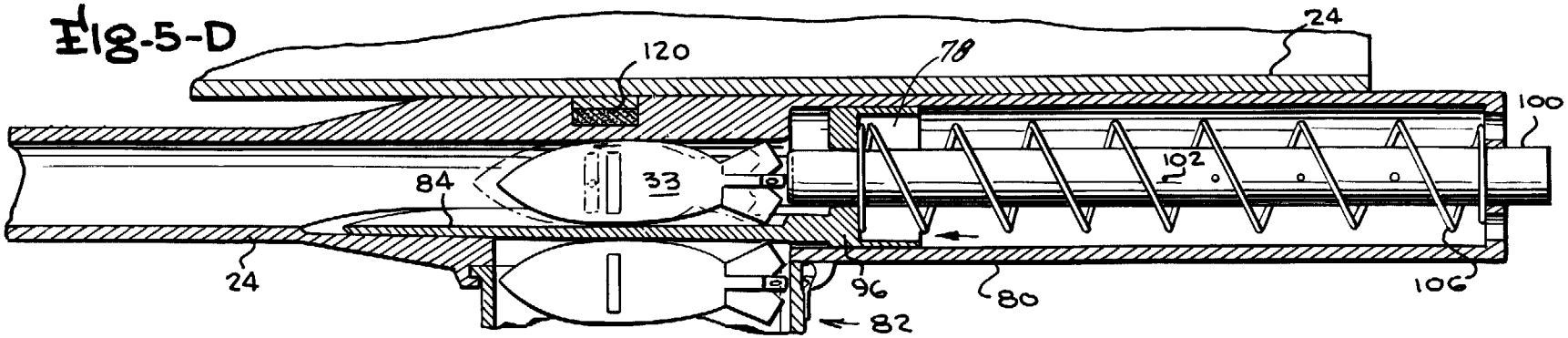
FIG-5-D
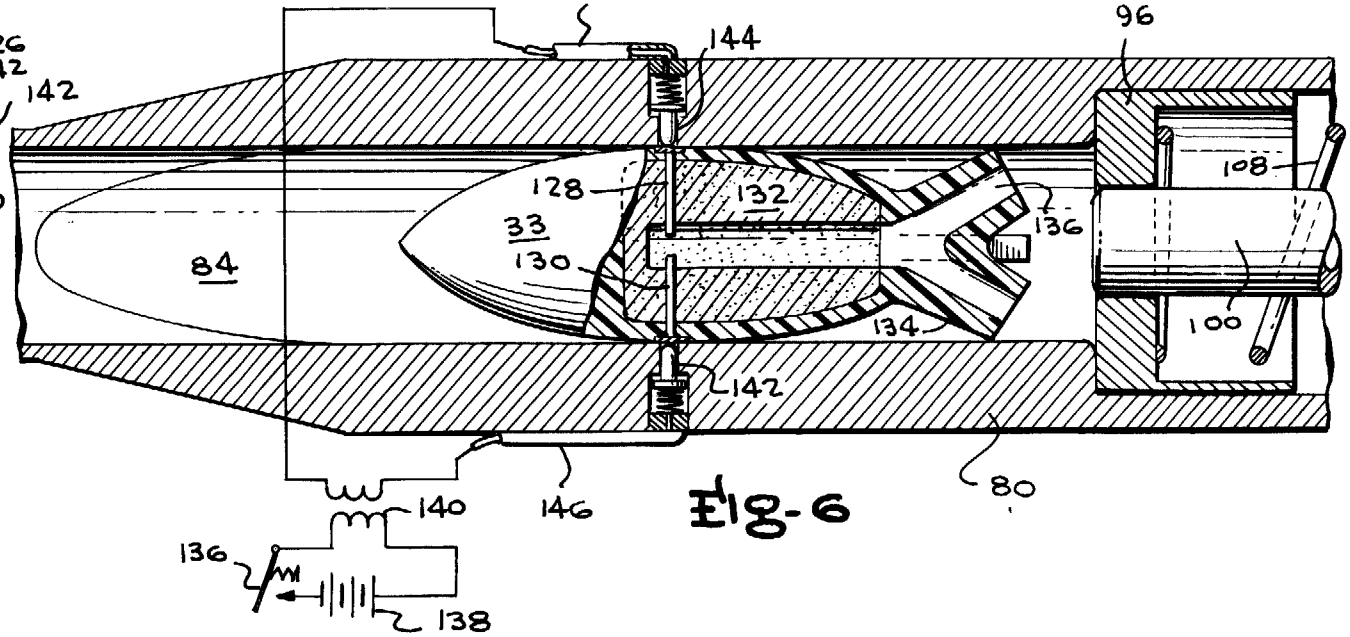
FIG-6
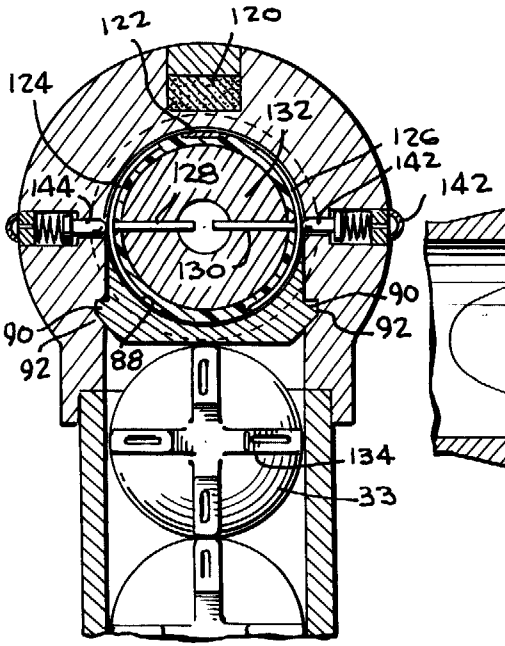
FIG-7

ARTILLERY WEAPON

The present invention relates generally to artillery weapons and more specifically to a weapon having side-by-side barrels with one of the barrels firing small rocket darts which permit targeting a larger rocket projectile barrel.

Prior known rocket projectile devices such as the bazooka, which is a portable shoulder weapon having an open breech smooth firing tube for launching armor piercing rockets, have been targeted visual sights. It has been the experience of individuals using these devices that the visual sights do not provide sufficient accuracy and therefore potential targets have been ignored because of the uncertainty of striking the target with the first projectile. Additionally, these prior known devices have necessitated their being positioned on the shoulder of the operator in order to utilize the visual sights. This position results in an unsteadiness which prevents the operator from observing the surrounding area while he is sighting along the barrel. The firing of tear gas containers has suffered from the same inaccuracy of targeting because of the high trajectory of the canister and its susceptibility to wind. The unsteadiness of the operator is increased by the emotional surroundings usually experienced when tear gas is being utilized. Due to the expense and weight of large rocket projectiles such as bazookas and tear gas canisters, many strikes have not been made with the previously known artillery because of the inability to accurately sight the weapon.

Therefore, it is the object of the present invention to provide a new and improved rocket firing artillery weapon.

Another object of the present invention is to provide a rocket firing artillery weapon with side-by-side barrels whereby a rocket dart barrel is used to target a projectile barrel by firing rocket darts from the first barrel until the darts strike the target at which time a rocket projectile may be fired from the projectile barrel thereby significantly decreasing the weight and expense necessary to accomplish a desired objective.

A further object of the present invention is to provide a rocket firing weapon having dual barrels wherein a targeting dart barrel fires relatively small and inexpensive targeting darts one after another from a magazine to permit targeting a rocket projectile barrel on target thereby permitting the firing of a projectile through the projectile barrel when the artillery is positioned on the hip of the operator without requiring him to sight through a visual sight which would distract his attention from the surrounding environment thereby creating a safety hazard under battlefield conditions.

It is a further object of the present invention to provide a rocket firing artillery weapon with a rocket projectile barrel having radial, longitudinal slots and a dart barrel having an axis parallel to the rocket projectile barrel wherein large rocket vanes may be utilized on the rocket projectile to provide a more accurate rocket trajectory.

A still further object of the present invention is to provide a dual barrel rocket artillery weapon in which rocket projectiles and darts are held in position by a magnet.

Another object of the present invention is to provide parallel axis synchronization of small caliber and large caliber projectiles for decisive hits.

A further object of the present invention is to provide infantrymen with a basic weapon designed for positive assurance of hitting and destroying a target.

An additional object of the present invention is to make virtually every soldier self-reliant, capable, and effective in any situation thereby increasing moral and efficiency in all combat units.

A still further object of the present invention is to provide a short range weapon for jungle or village warfare in which tranquilizer ammunition may be substituted for lethal ammunition in situations where civilians cannot be distinguished.

An additional object of the present invention is to provide a weapon which may be fired from the hip in offensive situations without any weapon recoil and yet may be fired from a prone, kneeling or off-the-shoulder position.

A better understanding of the manner in which the preferred embodiment of the invention achieves the objects of the invention will be enabled when the following written description is read in conjunction with the appended drawings in which.

Figures 3, 4:
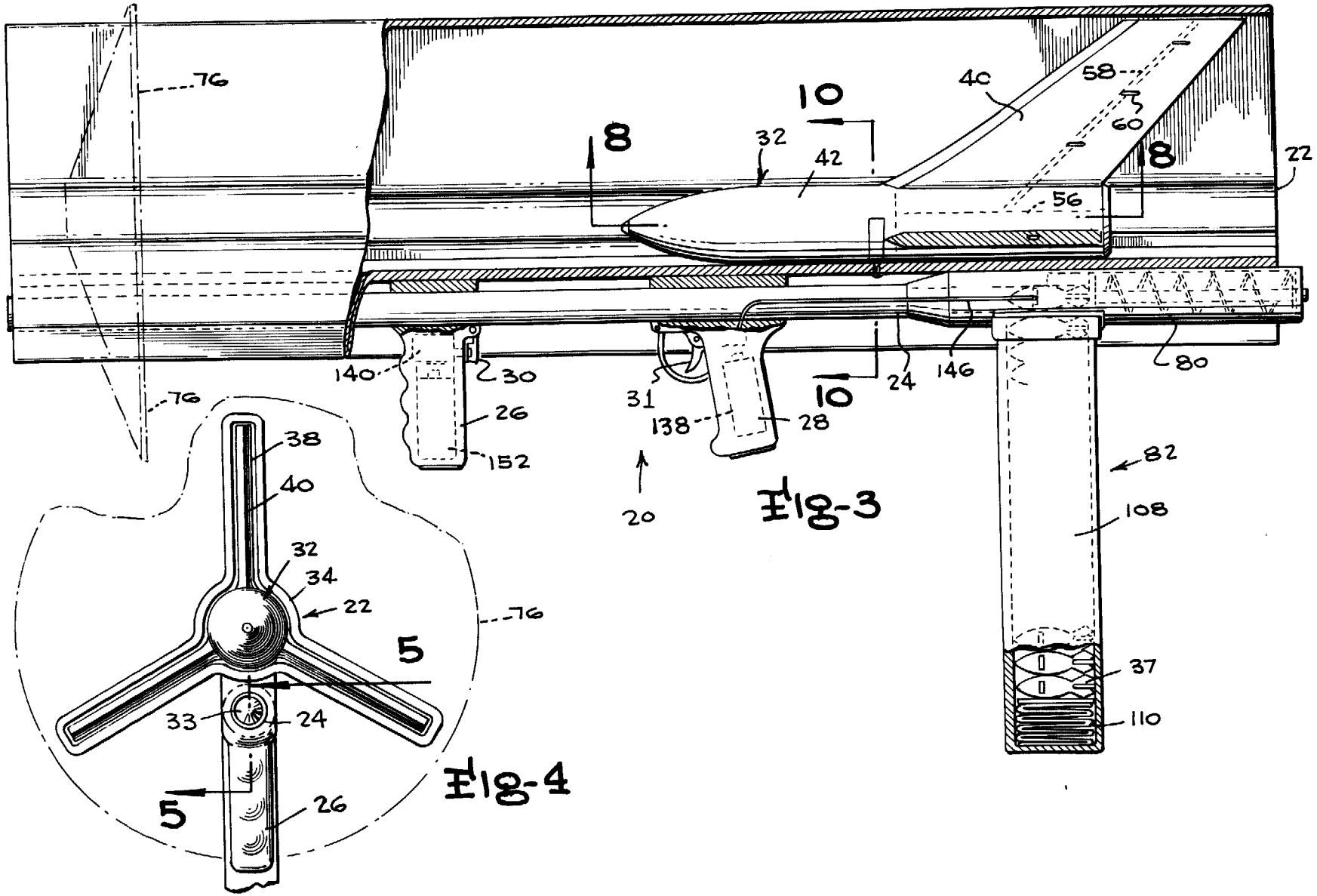
FIG. 3 is a side elevational view of the preferred embodiment shown in FIG. 2 with portions broken away to show a rocket projectile in the firing position and darts being fed to the firing position.
FIG. 4 is an end view of the preferred embodiment of the invention as viewed from the left of FIG. 1.
Figure 5:
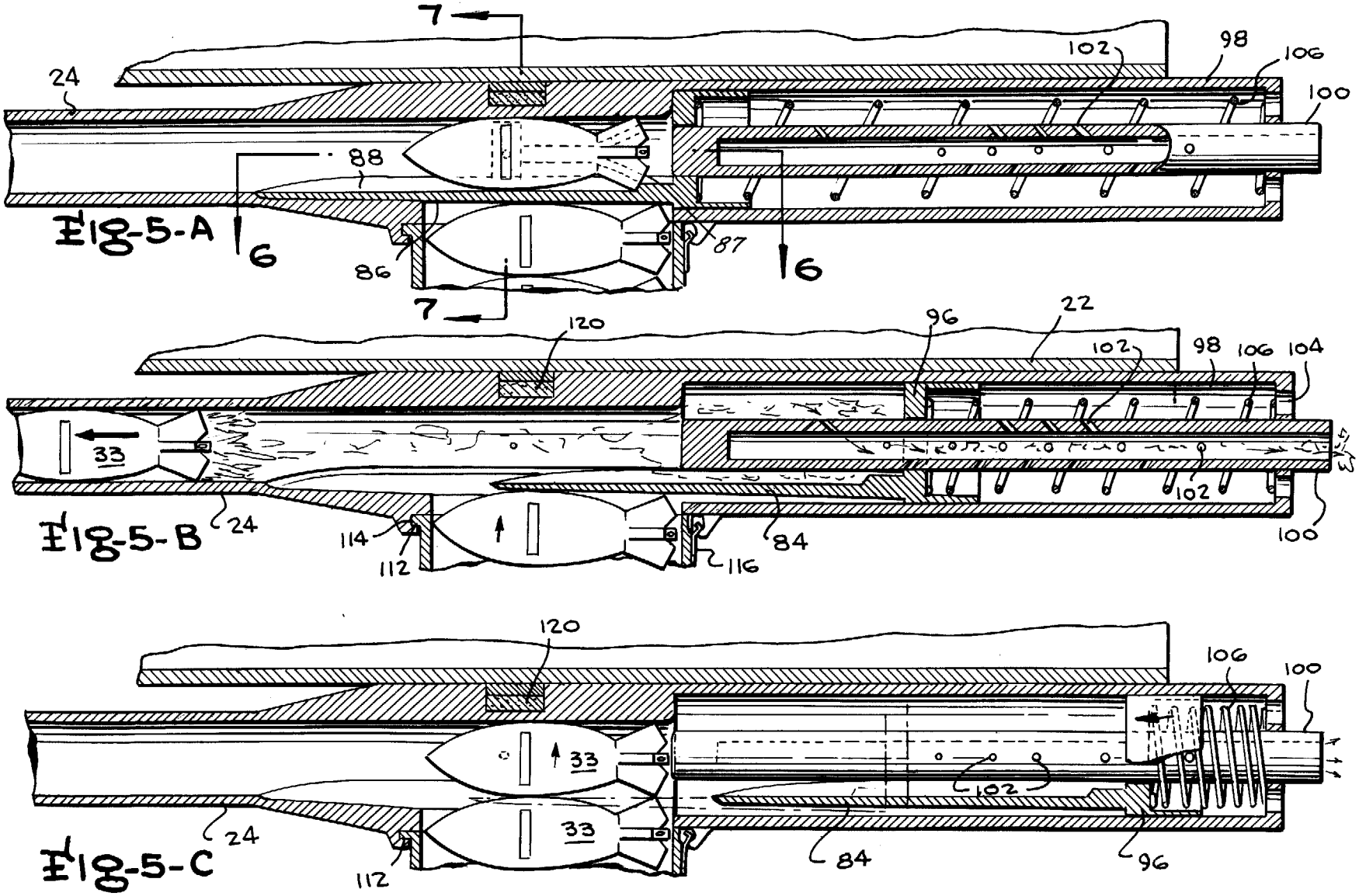
Figure 8:
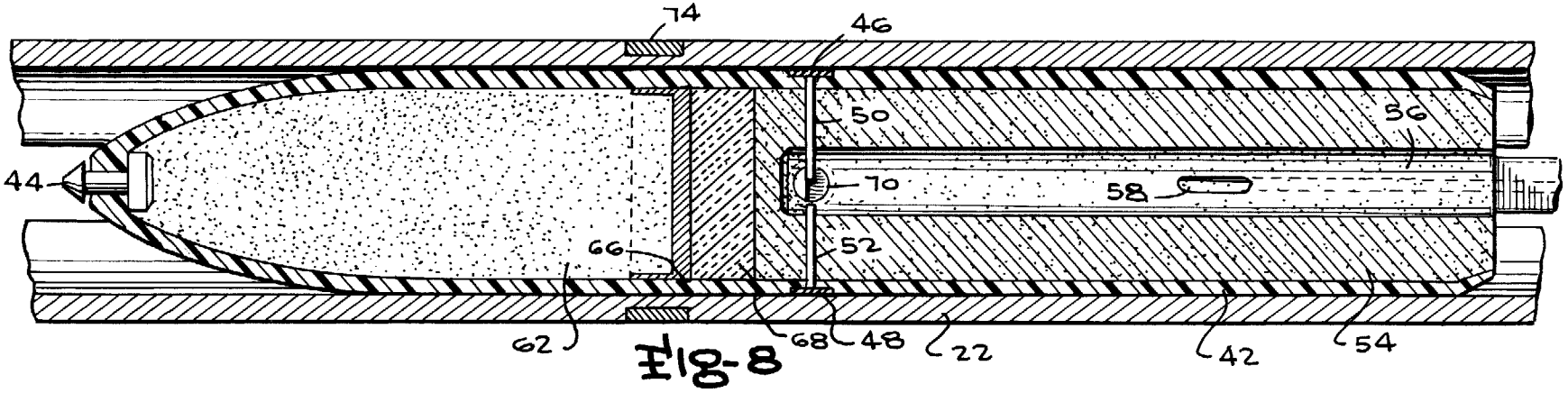
Figure 9:
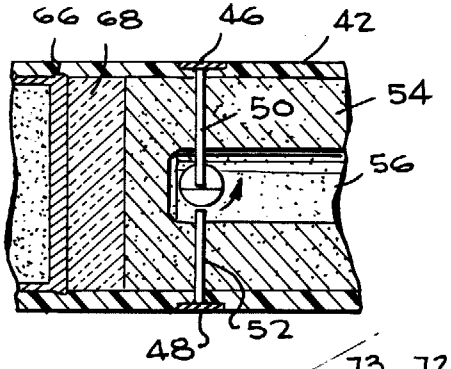
Figure 11:
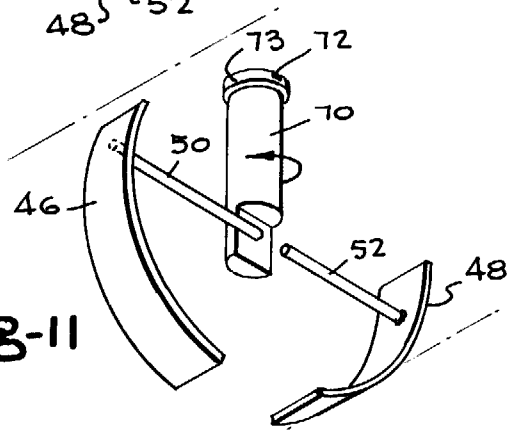
Figure 10:
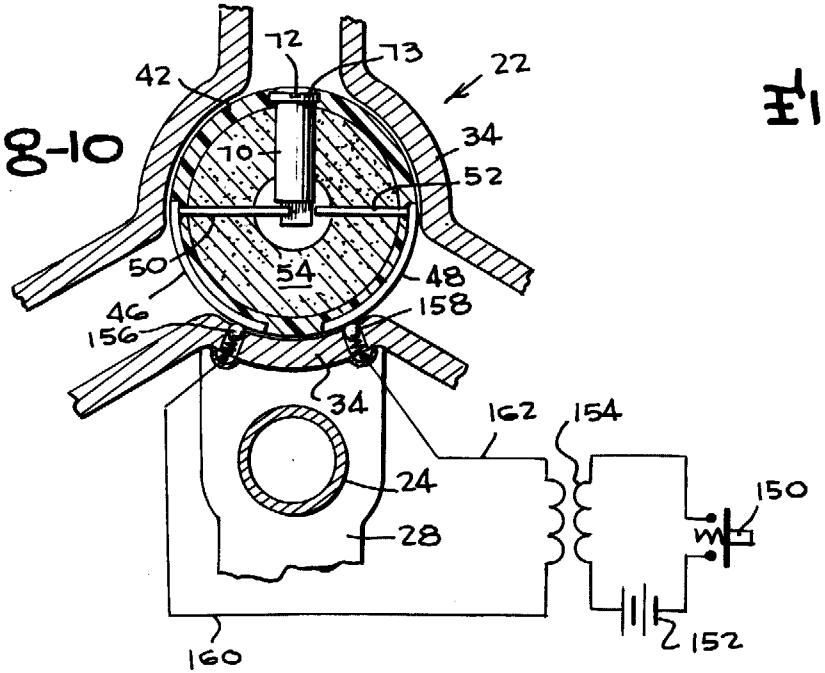

FIG. 5-A is a cross-sectional view taken along line 5—5 in FIG. 4 showing a dart in the firing position;

FIG. 5-B is similar to the sectional view shown in FIG. 5-A with the dart being propelled down the barrel and with the receiver plate being moved rearwardly by the propellant gases;

FIG. 5-C is a sectional view similar to FIG. 5-B with another dart being forced into the dart firing chamber when the receiving plate has been propelled to its rearmost position;

FIG. 5-D is a sectional view similar to FIG. 5-C with the receiving plate moving forward to push a dart into the firing position;

FIG. 6 is a sectional view of the dart and dart barrel as taken along line 6—6 in FIG. 5-A;

FIG. 7 is a sectional view taken along line 7—7 in FIG. 5-A showing a portion of the firing circuit for the darts;

FIG. 8 is a fragmentary cross-sectional view taken along line 8—8 in FIG. 3 showing the rocket projectile with the safety pin in the firing position;

FIG. 9 is a fragmentary cross-sectional view similar to FIG. 8 with the safety pin in the safe position;

FIG. 10 is a cross-sectional view taken along line 10—10 in FIG. 3; and FIG. 11 is a perspective view of the safety pin in the firing position with respect to the spark gap in the rocket projectile firing circuit and showing the contacts which are embedded in the outer surface of the rocket projectile.

Figure 1:
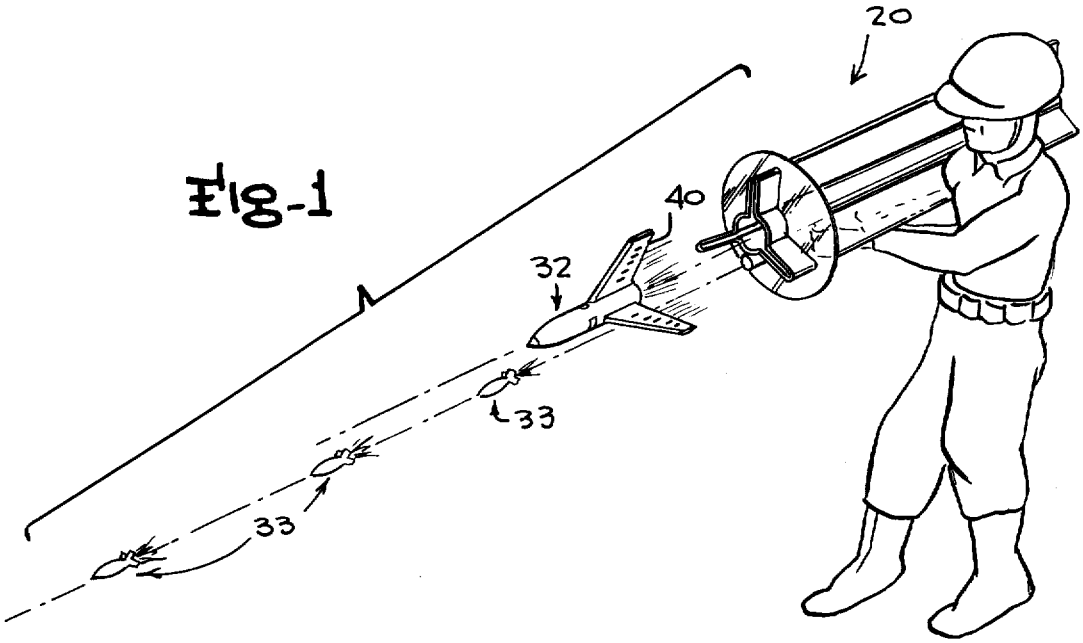
FIG. 1 is a perspective view of the preferred embodiment of the present invention being fired from the shoulder of a user.
Figure 2:
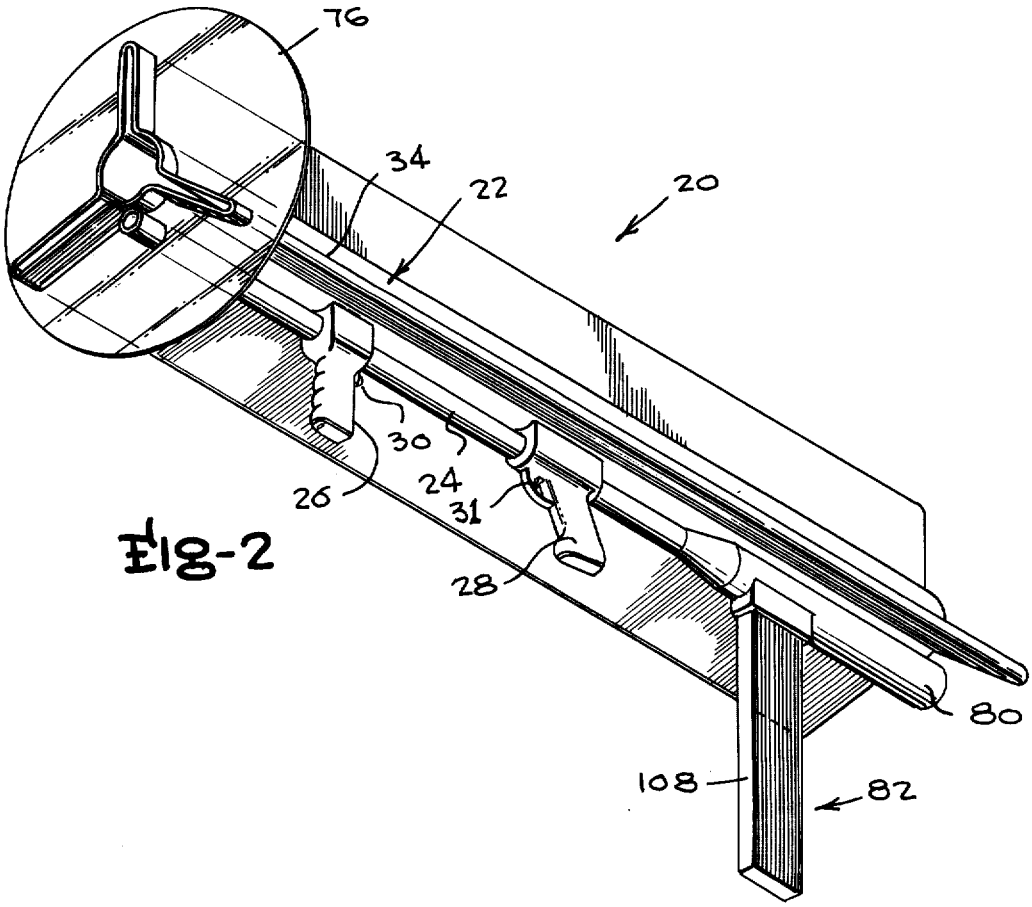
FIG. 2 is an enlarged perspective view as seen from the lower side of the preferred embodiment in FIG. 1.

Attention is initially invited to FIGS. 1, 2 and 3 of the drawings which illustrate the preferred embodiment of the invention, generally indicated with the numeral 20, including a rocket projectile barrel 22, a rocket dart barrel 24, a forward hand grip 26, a rear hand grip 28, a projectile trigger 30, a dart trigger 31, rocket projectiles 32 and rocket darts 33.

The projectile barrel 22 includes an elongated cylindrical tube 34 having a diameter slightly larger than the rocket projectile 32 which is to be fired from the projectile barrel. The cylindrical tube 34 has three equally spaced radial slots 38 which extend along the full length of the cylindrical tube to permit the use of the preferred rocket projectile 32 having radially extending fins 40 which fit closely within the radial slots 38. This configuration of the projectile barrel permits firing of a rocket projectile having fins which extend beyond the diameter of the body of the projectile to increase the aerodynamic stability of the projectile. The projectile barrel 22 may be formed from a single steel tube to provide the radial slots 38 and the cylindrical tube 34 as suggested by the view in FIG. 4.

In the preferred embodiment, the rocket projectile 32 as shown in FIGS. 3 and 8 includes a projectile body 42, contacts 46 and 48 mounted in the outer surface of the projectile body with the contacts insulated from the body 42 if the body is formed of an electrically conductive material. The contacts 46 and 48 are recessed slightly to avoid contact with the cylindrical tube 34 which would short out the electrical circuit which includes the contacts. The contacts 46 and 48 include electrodes 50 and 52, as shown, in FIG. 10 which extend radially inward toward the center of the projectile body 42 with their ends spaced apart to form a spark gap for igniting a solid propellant 54 contained within the rear portion of the projectile body 42. The solid propellant has a flow passageway 56 through the center thereof to permit the escape of exhaust gases from the rear of the projectile body to propel the projectile toward the desired target.

The fins 40, which are fixed to the projectile body 42, have flow passageways 58 which extend through the center of the fins and connect the exhaust passageway 56 through the solid propellant 54 with orifices 60 to vent the exhaust gases against the walls of the radial slots 38 to provide a gas cushion between the fins and the walls thereby reducing friction between the rocket projectile 36 and the projectile barrel 22 as the projectile moves down the barrel.

The rocket projectile 32 includes an explosive 62 contained in the forward portion of the projectile. The explosive is ignited upon striking a desired target by a detonator 44 which is of conventional construction. The solid propellant 54 is separated from the explosive 62 by a magnetic cap separator 66 and adjacent disc insulator 68 which fits closely within the projectile body 42 and prevents the ignition of the explosive 62 when the solid propellant 54 is fired.

The rocket projectile 36 includes a safety pin 70 which is generally cylindrical and formed of an insulating material such as plastic. The safety pin extends into the projectile body 42 to a position adjacent the spark gap formed between the electrodes 50 and 52. A lower portion of the safety pin is cut away as shown in FIG. 11 to permit arming of the rocket projectile, as indicated by the position in FIG. 11. The movement of the lower portion of the safety pin to a position between the electrodes as indicated in FIG. 9 is accomplished by inserting a fingernail or the like into a slot 72 formed at the upper end of the safety pin. The upper end of the safety pin may have a head 73 thereon as indicated in FIG. 10 which is recessed slightly in the projectile housing 42 to prevent damage during handling.

Permanent magnets 74 are mounted in the cylindrical tube 34 and attract the magnetic cap separator 66 to retain the projectile in the desired firing position. The projectile barrel 22 and dart barrel 24 extends through a disc-shaped blast shield 76 at the muzzle end thereof to shield the operator from the blast of exhaust gases as the rocket projectile 32 and the dart 33 leave the weapon as indicated in FIG. 1.

The dart barrel 24 is mounted below the projectile barrel 22 with the axis of the dart barrel generally parallel to the axis of the rocket barrel thereby permitting the firing of darts and projectiles with the same trajectory thereby causing the darts to strike a desired target the same distance apart as the space between barrels. As best shown in FIGS. 2 and 3, the upper portions of the forward hand grip and the rear hand grip surround the dart barrels 24 and are attached to a lower side of the cylindrical tube 34 to mount the dart barrel in the desired position.

A receiver plate assembly 78 is mounted in an enlarged rear portion of the dart barrel 24 which interacts with a dart magazine assembly 82 to feed the dart projectiles 33 into the dart barrel 24. The receiver plate assembly 78 includes a receiver plate 84 which closes a port opening 86 in the side of an enlarged rear portion 80 of the dart barrel. Darts 33 from the magazine assembly 82 pass through port opening 86 and into the dart barrel 24 as indicated in FIGS. 5-A through D. The receiver plate 84 has a cylindrical inner surface 88 as shown in FIG. 7 with guide rails 90 which slide in matching grooves 92 into a firing position wherein the receiver plate covers the port opening 86 from the magazine assembly. A shoulder 87 on the receiver plate engages the dart as shown in FIG. 5-A. With the receiver plate over the port opening, the darts may be fired. The receiver plate is integral with a retract piston 96 which is free to travel in an enlarged bore 98 coaxial with the dart barrel 24.

A hollow guide tube 100 extends along the center of the enlarged bore 98 and passes through a close fitting bore in the retract piston 96 to provide a guide for the piston. The guide tube 100 is closed at an end adjacent the firing position of the dart and has exhaust gas orifices 102 as shown in FIGS. 5-A through D through which the exhaust gases from the fired darts may escape as the retract piston moves rearwardly along the guide tube and sequentially opens the exhaust orifices to permit the exhaust gases to escape rearwardly through the center of the guide tube 100. Exhaust ports 104 vent the enlarged bore 98 to the atmosphere to permit movement of air into and out of the enlarged bore as the retract piston 96 assumes the various positions shown in FIGS. 5-A through D. A return spiral wound spring 106 surrounding the guide tube 100 presses against a rear surface of the retract piston 96 to cause the retract piston and receiver plate 84 to return to the forward or firing position as shown in FIG. 5-A after the exhaust gases have been vented through orifices 102.

The dart magazine assembly 82 includes a housing 108 having a rectangular cross-section and sized to hold the darts 33 which are stacked in the magazine one on top of another as shown in FIG. 3. The darts are forced upwardly into the dart barrel by a dart biasing spring 110 which presses against the housing 108 and the darts to permit feeding of the darts into the dart barrel. The magazine assembly is attached to the enlarged rear portion 80 of the dart barrel by a forward retaining lip 112 which is inserted into a notch 114 on the enlarged portion as indicated in FIG. 5-B. A spring clip 116 on the back of the housing 108 snaps into a retaining finger 118 on the enlarged porton 80 thereby holding the magazine assembly in the desired position.

The darts 33 may be retained in the desired firing position by a permanent magnet 120 as shown in FIG. 5-A. The dart may have a magnetic plate 122 as shown in FIG. 7 to precisely align the dart in the desired position. The darts are similar to the rocket projectiles and include contacts 124 and 126, as shown in FIG. 7, with electrodes 128 and 130 extending toward the center of the dart and spaced apart to provide a spark gap which can be used to ignite solid propellant 132.

The dart includes four vanes 134 at the rear thereof having passageways 136 therethrough which communicate with the solid propellant 132 to permit the escape of exhaust gases from the solid propellant to propel the dart toward the desired target.

The firing of both the dart and the projectile is accomplished with similar circuits as shown in FIGS. 6 and 10. The dart firing circuit, shown schematically in FIG. 6, includes a switch 136 which is actuated by the trigger 31 to complete the circuit from a battery 138 contained in the rear hand grip 28 through a transformer 140. The transformer 140 causes a buildup in voltage across electrodes 128 and 130 which are connected by spring biased contacts 142 and 144 in the enlarged portion 80 of the dart barrel through lead wires 146 and 148 to the output leads from the transformer.

The rocket projectile is fired by the circuit shown in FIG. 10 which includes a switch 150 which is actuated by the projectile trigger 30 as shown in FIG. 3. Actuation of the projectile switch 150 closes the circuit through a battery 152 contained in the forward hand grip 26 through a transformer 154. The buildup in voltage in the transformer 154 is applied to the electrodes 50 and 52 through spring biased contacts 156 and 158 mounted in the cylindrical tube 34 of the projectile barrel as shown in FIG. 10. Lead wires 160 and 162 connect the spring biaed contacts to the leads from the transformer 154 as shown in FIG. 10 thereby completing the firing circuit.

Operation of the weapon is accomplished by filling the dart magazine assembly 82 with darts and snapping the magazine housing 108 into position on the dart barrel as indicated in FIGS. 3 and 5-A through B. The receiver plate 84 is retracted to the rearmost position by a manual actuation knob, which is not shown, or a dart 33 may be dropped down the barrel into a firing position. If the receiver plate is retracted, the dart biasing spring 110 forces a dart 33 into the dart barrel, as shown in FIG. 5-C, at which time the retaining plate 84 is permitted to return to the firing position indicated in FIG. 5-A under the biasing force of the return spring 106. The dart will be retained in the desired firing position by the magnet 120.

A rocket projectile may then be armed by rotating the safety pin 70 with slot 72 to place the projectile in the armed condition. The projectile is then hand fed into the projectile barrel 22 to the firing position where it will be retained by the magnet 74. The spring biased contacts 142 and 144 will touch the contacts 124 and 126 on the dart to complete the firing circuit through the dart. Likewise, the spring biased contacts 156 and 158 will touch the contacts 46 and 48 on the projectile to complete the firing circuit for the projectile.

The user then aims the weapon in the general direction and pulls the dart trigger 32 which will fire the dart 33 from the firing position causing it to move down the barrel as indicated in FIG. 5-B. Simultaneously the retract piston 96 will be driven rearwardly by the exhaust gases from the dart against the return spring 106 and as the retract piston moves rearwardly it will sequentially open the exhaust orifices 102 to vent the exhaust gases out the back of the guide tube 100 as indicated in FIG. 5-B. When the receiver plate 84 has cleared the port opening 86, a new dart 33 will be pushed into the dart barrel by the dart biasing spring 110. With the exhaust gases having been vented from in front of the retract piston 96, the piston and the receiver plate 84 will be pushed forward by the return spring 106 as shown in FIG. 5-D. As the receiver plate 84 approaches the firing position, the shoulder 87 on the retaining plate will engage the dart and push it forward to the firing position as shown in FIG. 5-A. If the trigger is still depressed, the contacts 124 and 126 on the dart will engage the spring biased contacts 142 and 144 which fill fire the next dart.

The user will fire as many darts as necessary to target the weapon on the desired target at which time he will depress the projectile trigger whereby applying a voltage across the contacts 46 and 48 to the electrodes 50 and 52 which will cause a spark to ignite the solid propellant 54 and fire the projectile at the desired target.

Numerous modifications of the subject invention will undoubtedly occur to those of skill in the art such as tear gas projectiles or projectiles which are mechanically fired and mechanically retained in the desired positions. It should, therefore, be understood that the spirit and scope of the invention are to be limited solely in light of the appended claims.

I claim:

1. A hand-held artillery weapon for aiming a rocket projectile at a desired target by targeting the weapon with rocket darts, said weapon comprising a projectile barrel for lauching the rocket projectile, a dart barrel mounted on the projectile barrel with the axis of the dart barrel generally parallel to the axis of the projectile barrel, magazine means for supplying an unfired dart to the dart barrel after a dart has been fired, means for retaining the dart in the dart barrel prior to firing of the dart, means for firing a dart retained in the dart barrel, means for retaining a projectile in the projectile barrel prior to firing of the projectile and means for firing the projectile thereby providing an artillery weapon which can be targeted on a desired target by firing as many rocket darts as necessary to position the projectile barrel in the desired orientation for firing of the rocket projectile.

2. The artillery weapon of claim 1 wherein the means for retaining the dart in the dart barrel includes a magnetic area on the dart and a magnet on the dart barrel positioned to attract the magnetic area on the dart when the dart is in a firing position thereby holding the dart in the firing position until the dart is fired.

3. The artillery weapon of claim 1 wherein the means for retaining the rocket projectile in the rocket barrel includes a magnetic area on the projectile and a magnet on the rocket barrel positioned to attract the magnetic area on the projectile when the projectile is in the desired firing position thereby holding the projectile in the firing position until the projectile is fired.

4. The artillery weapon of claim 1 wherein the means for firing the dart includes a circuit having a spark gap in the dart and electrical means for applying a voltage in the circuit to create a spark across the spark gap to ignite the dart propellant.

5. The artillery weapon of claim 1 wherein the projectile barrel has a plurality of spaced apart longitudinal slots extending over the length thereof to permit use of projectiles having fins extending radially from the projectile body and positonable within said slots.

6. The artillery weapon of claim 1 wherein the magazine includes a housing mounted on the side of the dart barrel, said housing having an opening from the housing into the barrel of a size to permit a dart to be pushed therethrough, spring biasing means for pushing a dart into the barrel through said opening, receiver plate means positionable over said opening for preventing the escape of exhaust gases into the magazine when a dart is fired and means for retracting the receiver plate with the exhaust gases from a fired dart for permitting a dart from the magazine to be inserted into the barrel after a fired dart has left the barrel.

7. The artillery weapon of claim 1 wherein the means for firing the projectile includes an electrical circuit having a spark gas in the projectile and electrical means for applying a voltage in the circuit to create a spark across the spark gap to ignite the projectile propellant.

8. The artillery weapon of claim 7 wherein the electrical means for firing the projectile includes a battery and a switch in the circuit whereby closing the switch applies a voltage across the gap to ignite the propellant in the projectile.

9. The artillery weapon of claim 8 wherein the circuit includes a contact on the projectile, and a spring biased contact extending inwardly into the projectile barrel and connected to the switch, said contact ring in electrical connection with the spark gap when the projectile is in the firing position whereby closing the switch will cause a spark across the spark gap to ignite the projectile propellant.

* * * * *